US010151148B2

(12) United States Patent
Curry et al.

(10) Patent No.: US 10,151,148 B2
(45) Date of Patent: Dec. 11, 2018

(54) COMPOSITE METALLIC ELASTOMERIC SEALING COMPONENTS FOR ROLLER CONE DRILL BITS

(71) Applicant: Baker Hughes Incorporated, Houston, TX (US)

(72) Inventors: David A. Curry, The Woodlands, TX (US); Terry J. Koltermann, Corpus Christi, TX (US); Chih C. Lin, Spring, TX (US); Stuart Hall, Cheshire (GB)

(73) Assignee: Baker Hughes Incorporated, Houston, TX (US)

( * ) Notice: Subject to any disclaimer, the term of this patent is extended or adjusted under 35 U.S.C. 154(b) by 657 days.

(21) Appl. No.: 14/605,639

(22) Filed: Jan. 26, 2015

(65) Prior Publication Data

US 2015/0144406 A1 May 28, 2015

Related U.S. Application Data

(62) Division of application No. 12/699,175, filed on Feb. 3, 2010, now Pat. No. 8,967,301.

(51) Int. Cl.
*E21B 10/25* (2006.01)
*E21B 10/22* (2006.01)

(52) U.S. Cl.
CPC ..... *E21B 10/25* (2013.01); *E21B 2010/225* (2013.01)

(58) Field of Classification Search
CPC ..... E21B 10/25; E21B 10/22; E21B 10/24; E21B 2010/225; F16J 15/0893; F16J 15/3212; F16J 15/121
See application file for complete search history.

(56) References Cited

U.S. PATENT DOCUMENTS 3,313,552 A 4/1967 McElya et al.
3,370,895 A 2/1968 Cason, Jr.
3,389,760 A * 6/1968 Morris ..... E21B 10/10 175/371
3,397,928 A 8/1968 Galle et al.
3,467,448 A 9/1969 Galle
3,765,495 A 10/1973 Murdoch et al.
3,917,294 A * 11/1975 Abbes ..... F16J 15/0893 277/639

(Continued)

FOREIGN PATENT DOCUMENTS

EP 1533468 B1 12/2008

OTHER PUBLICATIONS

US 5,887,981, 03/1999, Slaughter et al. (withdrawn)

(Continued)

*Primary Examiner* — Kipp C Wallace
(74) *Attorney, Agent, or Firm* — TraskBritt

(57) ABSTRACT

An earth boring bit has a bit body with a depending bearing pin, a cone rotatably mounted on the bearing pin, a seal gland between the cone and the bearing pin, and a seal assembly located in the seal gland. The seal assembly includes an annular metallic spring encircling the bearing pin. The spring has a geometric center line that extends in a circle around the bearing pin. The spring is elastically deformable in radial directions relative to the center line. An elastomeric layer is located on an exterior side of the spring and is biased by the spring against a surface of the seal gland.

13 Claims, 6 Drawing Sheets

(56) References Cited

U.S. PATENT DOCUMENTS 3,944,306 A 3/1976 Neilson
4,014,595 A 3/1977 Dolezal et al.
4,199,156 A * 4/1980 Oldham ..... E21B 10/25 175/371
4,218,067 A 8/1980 Halling
4,372,624 A 2/1983 Neilson et al.
4,428,558 A 1/1984 Odogaki et al.
4,428,588 A 1/1984 Oelke
4,428,687 A 1/1984 Zahradnik
4,429,854 A 2/1984 Kar et al.
4,494,749 A * 1/1985 Evans ..... E21B 10/18 175/17
4,516,641 A 5/1985 Burr et al.
4,519,614 A 5/1985 Gamer
4,519,719 A * 5/1985 Burr ..... E21B 10/25 384/94
4,588,309 A 5/1986 Uyehara et al.
4,610,319 A 9/1986 Kalsi et al.
4,610,452 A 9/1986 DiRienz
4,613,004 A 9/1986 Shotwell et al.
4,619,534 A 10/1986 Daly et al.
4,623,028 A 11/1986 Murdoch et al.
4,666,001 A 5/1987 Burr et al.
4,671,368 A 6/1987 Burr et al.
4,722,404 A 2/1988 Evans
4,722,615 A 2/1988 Bailey et al.
4,747,604 A 5/1988 Nakamura
4,753,303 A 6/1988 Burr
4,753,304 A 6/1988 Kelly et al.
4,772,404 A 9/1988 Fox et al.
4,822,057 A 4/1989 Chia et al.
4,824,123 A 4/1989 Chia et al.
4,838,365 A 6/1989 Kotch et al.
4,851,068 A 7/1989 Uyehara
4,903,786 A 2/1990 Welsh et al.
4,923,020 A 5/1990 Kelly et al.
5,022,663 A * 6/1991 Fages ..... F16J 15/0893 277/644
5,027,911 A 7/1991 Dysart
5,037,281 A 8/1991 Lane et al.
5,080,183 A 1/1992 Schumacher et al.
5,152,353 A 10/1992 Denton et al.
5,161,806 A 11/1992 Balsells
5,323,863 A 6/1994 Denton et al.
5,360,076 A 11/1994 Kelly et al.
5,362,073 A 11/1994 Upton et al.
5,402,858 A 4/1995 Quanttz et al.
5,441,120 A 8/1995 Dysart et al.
5,456,327 A 10/1995 Denton et al.
5,513,711 A 5/1996 Williams
5,513,715 A 5/1996 Dysart
5,524,718 A 6/1996 Kirk et al.
5,570,750 A 11/1996 Williams
5,577,472 A 11/1996 Banta, III et al.
5,655,611 A 8/1997 Dolezal et al.
5,738,358 A 4/1998 Kalsi et al.
5,791,421 A 8/1998 Lin
5,842,700 A 12/1998 Fang et al.
5,842,701 A 12/1998 Cawthorne et al.
5,875,861 A 3/1999 Daly et al.
RE36,452 E 12/1999 Upton et al.
6,026,917 A 2/2000 Zahradnik et al.
6,033,117 A 3/2000 Cariveau et al.
6,045,029 A 4/2000 Scott et al.
6,123,337 A 9/2000 Fang et al.
6,142,249 A 11/2000 Zahradnik et al.
6,170,830 B1 1/2001 Cawthorne et al.
6,176,330 B1 1/2001 Burr
6,179,216 B1 1/2001 Panhelleux
6,209,185 B1 4/2001 Scott
6,247,545 B1 6/2001 Burr et al.
6,254,275 B1 7/2001 Slaughter et al.
6,264,367 B1 7/2001 Slaughter et al.
6,305,483 B1 10/2001 Portwood
6,336,512 B1 1/2002 Siracki et al.
6,357,540 B1 3/2002 Page et al.
6,406,030 B1 6/2002 Fang et al.
6,427,790 B1 8/2002 Burr
6,513,607 B2 2/2003 Peterson et al.
6,536,542 B1 3/2003 Fang et al.
6,598,690 B2 7/2003 Peterson
6,631,910 B2 10/2003 Caplain et al.
6,679,342 B2 1/2004 Portwood et al.
6,684,966 B2 2/2004 Lin et al.
6,688,604 B2 * 2/2004 Hashimoto ..... F16J 15/006 277/558
6,752,223 B2 6/2004 Panigrahi et al.
6,789,634 B1 9/2004 Denton
6,820,704 B2 11/2004 Mourik et al.
6,976,548 B2 12/2005 Neville et al.
7,013,998 B2 3/2006 Ray et al.
7,036,613 B2 5/2006 Burr
7,117,961 B2 10/2006 Yong et al.
7,188,691 B2 3/2007 Yong et al.
7,201,241 B2 4/2007 Neville et al.
7,234,541 B2 * 6/2007 Scott ..... E21B 10/25 175/372
7,347,290 B2 3/2008 Yu et al.
7,387,178 B2 6/2008 Neville et al.
7,413,037 B2 * 8/2008 Lin ..... E21B 10/25 175/371
7,461,708 B2 12/2008 Yong et al.
7,464,941 B2 12/2008 Hashimoto
7,497,443 B1 3/2009 Steinetz et al.
7,736,122 B1 6/2010 Stone
8,100,410 B2 * 1/2012 Alacqua ..... F16J 15/0893 277/591
8,146,924 B2 4/2012 Ohmi et al.
8,182,153 B2 5/2012 Singh et al.
2006/0065445 A1 3/2006 Chellappa et al.
2006/0103076 A1 5/2006 Hashimoto
2006/0220327 A1 * 10/2006 Russell ..... F16L 37/0845 277/611
2007/0181843 A1 8/2007 Welty et al.
2008/0309028 A1 12/2008 Ohmi et al.
2009/0038858 A1 2/2009 Griffo et al.
2009/0045585 A1 2/2009 Gallifet et al.

OTHER PUBLICATIONS

European Office Action for European Application No. 11152835.2 dated Mary 29, 2017, 4 pages.
European Search Report for European Application No. 11152835.2 dated Oct. 10, 2014, 12 pages.
Canadian Office Action for Canadian Application No. 2,730,409 dated Apr. 10, 2013, three pages.
Canadian Office Action for Canadian Application No. 2,730,409 dated Jan. 24, 2014, two pages.
Canadian Office Action for Canadian Application No. 2,730,409 dated Oct. 28, 2014, two pages.
Canadian Office Action for Canadian Application No. 2,730,409 dated Jul. 4, 2012, three pages.

* cited by examiner

COMPOSITE METALLIC ELASTOMERIC SEALING COMPONENTS FOR ROLLER CONE DRILL BITS

CROSS-REFERENCE TO RELATED APPLICATION

This application is a divisional of U.S. patent application Ser. No. 12/699,175, filed Feb. 3, 2010, now U.S. Pat. No. 8,967,301, issued Mar. 3, 2015.

TECHNICAL FIELD

This invention relates in general to sealing components for sealing between a rotating cone and bearing pin, and in particular to a composite sealing component that has a metallic spring and an elastomeric layer.

BACKGROUND

A roller cone earth-boring bit has a bit body with typically three bit legs. A bearing shall or pin depends downward and inward from each bit leg toward the bit body axis of rotation. A cone having cutting elements on its exterior mounts rotatably on each bearing pin. A seal gland is located at the mouth of the cone and the base of the bearing pin. A variety of seal assemblies may be mounted in the seal gland to seal lubricant in the bearing spaces and inhibit the entry of drilling fluid into the bearing spaces.

The sealing elements have to perform at least two functions, including providing an appropriate sealing force against the surface being sealed and conforming to the surfaces being sealed. These functions have to be performed for the intended service duration in the service environment. Among other things, this requires that the sealing elements resist chemical and mechanical attack by the materials being excluded and sealed and further that they resist detrimental changes in properties in their service environment.

Oilfield roller cone drill bits are required to operate m conditions of severe mechanical vibration, high pressures (frequently greater than 10,000 psi and potentially greater than 20,000 psi) and moderately high temperatures (frequently greater than 150° C., and potentially greater than 200° C.), when immersed in aqueous and/or hydrocarbon-based fluids. The fluids frequently contain, substantial volume fractions of potentially abrasive solid particles. The bit bearings are lubricated with grease supplied from internal reservoirs. The bearings are sealed in order to prevent the solids containing drilling fluid from entering the bearing. Typically the primary seal is placed between the rotating cone and the pin on which it rotates. Rapid bearing wear leading to premature bearing failure occurs should a seal fail in service. There are two main classes of seals in use in oilfield roller cone bits today—elastomeric and mechanical face seals.

The majority of elastomeric seals are "O" rings, but high aspect ratio (HAR) elastomeric seals are also used. Radial compression of the seal cross section provides the sealing force and the relatively soft and pliable nature of the elastomer allows it to conform quite closely to the surfaces of the glands against which it runs. The primary processes limiting the operating life of elastomeric seals are (1) abrasive wear of the sliding surfaces and (2) compression set at elevated operating temperature, causing the seal to harden and permanently deform. Both these processes cause the seal to lose its "squeeze" or sealing force. There are many patents relating to elastomeric seals, their geometry and materials.

The sealing components of mechanical face seals are typically hard metals with flat sealing surfaces that slide one over the other. One or more of the sliding surfaces may be coated with a wear resistant layer. In commercially successful metal face seals, the sealing force is provided by one or two elastomeric energizer elements forcing the sealing elements one against the other. The energizer and the separate elastomeric back-up ring, if provided, provide static sealing in addition to the dynamic seal provided by the metallic sliding surfaces. Abrasive wear of the sliding metallic surfaces can lead to seal leakage. So too can loss of sealing force arising from compression set of the elastomeric energizer. In some instances, leakage may occur due to abrasive wear if the energizer slides unintentionally against its static seat. A mechanical face seal may fail prematurely if the sealing faces open temporarily during transient rocking or inward movement of the cone on the bearing pin. If the faces open, solids containing drilling fluid may enter the seal and promote wear of the sealing surfaces. The failure mode is likely to become more prevalent if the energizer does not respond sufficiently rapidly to the transient motion of the cone, for instance, if it possesses high internal damping. There are many patents relating to mechanical face seals for oilfield roller cone bits and for other applications. Some of these relate to the use of metallic springs to provide the sealing force.

BRIEF SUMMARY

A sealing component of this invention utilizes a metallic spring element having an elastomeric layer. The spring element is a continuous annular member having a circular, geometric center line extending around a first member of a downhole well tool. A second member of the downhole well tool surrounds and is rotatable relative to the first member. When the spring element is deformed, its resiliency causes forces to be directed outward along radial lines in opposite directions from the center line. The elastomeric component engages one or more surfaces of the seal gland and seal assembly.

In one embodiment, the spring comprises a metal tube that is formed into an annular continuous configuration. The tube has an annular gap or circumferential slit that extends around the annular circumference of the tube. An elastomeric layer covers the portions of the spring that engage the seal gland and seal assembly. The elastomeric layer may be only on the exterior side of the spring or it may also be on the interior side. The interior of the seal element and the gap may also be filled with an elastomeric material. When deformed between surfaces of the seal gland, the diameter of the cylindrical configuration shrinks, and the gap in the spring decreases in width.

In another embodiment, the tubular spring has transverse slits in its side wall that are formed transversely to the circular center line. The transverse slits may be parallel to each other and spaced in a row around the circumference of the tube. There may be two sets or rows of slits, one located on one side of the spring and another on an opposite side. Each set of slits has one end that intersects the gap. However, the two sets of slits do not join each other on the opposite ends. This arrangement leaves a continuous band of metal extending around the annular circumference of the spring. The elastomeric layer extends over all of the transverse slits so as to enable the seal component to form a seal.

In both of these examples, the gap in the continuous metal tube is located in a position so that it does not contact a sealing surface of the seal assembly or seal gland. If the gap in the seal component remains open, rather than being filled with an elastomer, preferably it is oriented so that lubricant within the lubricant passages of the well tool will communicate to the interior of the seal component.

In still another embodiment, the seal component comprises a helically wound wire spring forming a continuous annular member. The turns of the spring are continuous with no gap being present in this embodiment. Spaces do exist between the turns of the wire spring. The elastomeric layer covers the exterior and also fills the spaces between the turns of the wire spring.

In another embodiment, the spring comprises at least one, and preferably more than one, wavy spring encircling the first member of the downhole well tool. The spring has undulations defining peaks and valleys. The peaks circumscribe an annular outer diameter of the spring and the valleys circumscribe an annular inner diameter of the spring. Preferably, the undulations are out-of-phase with each other.

The seal component may be utilized in various manners. In one manner, the seal component comprises an energizing ring that is employed to urge a rigid face into sealing engagement with a second rigid face. One of the rigid faces rotates relative to the other rigid face. The energizing ring is located in a conventional place with one side in static contact with the one of the rigid faces, urging it into engagement with the other rigid face. The seal component could also be a backup seal in static contact with the one of the rigid faces.

In another embodiment, the seal component comprises a primary seal that may be located within a groove between two members, one of the members being rotatable relative to the other. One portion, of the elastomeric layer is in sliding contact with one member and another portion is in static contact with the other member.

DETAILED DESCRIPTION

Figure 1:
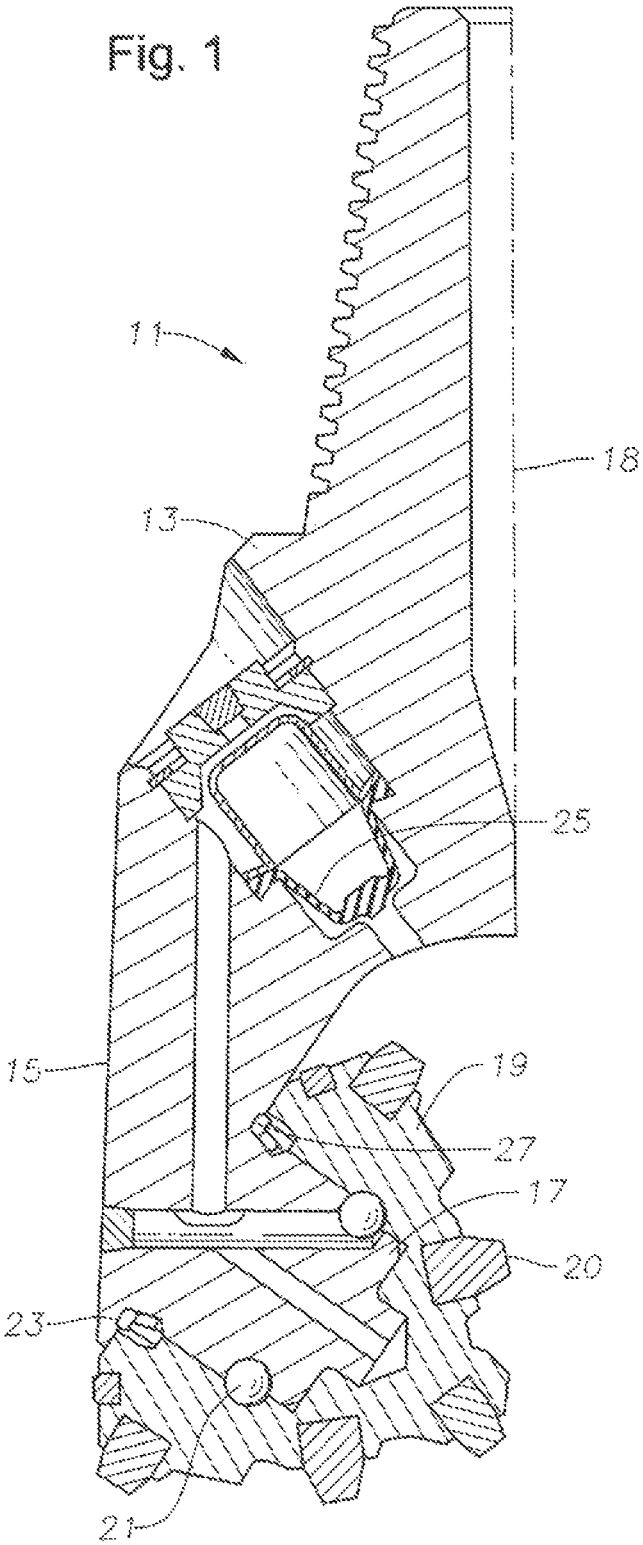
FIG. 1 is a partial sectional view illustrating an earth-boring bit having a seal assembly in accordance with this invention and located in a seal gland between a roller cone and a bearing pin.

Referring to FIG. 1, earth-boring bit 11 has a body 13 with at least one depending bit leg 15. Typically, bit 11 will have three bit legs 15. Each bit leg 15 has a first member or bearing pin 17 located at the lower end of bit leg 15. Bearing pin 17 extends downward and inward toward bit body axis 18. A second member or cone 19 has a cavity that receives bearing pin 17. Cone 19 rotates relative to bearing pin 17 when bit body 13 is rotated about axis 18. Cone 19 has cutting elements 20 on its exterior that engage the bore hole bottom and disintegrate the earth formation. Cutting elements 20 may be tungsten carbide inserts press fitted into mating holes in cone 19 as shown in FIG. 1. Alternatively, they may comprise teeth that are machined from the body of cone 19. A retaining system holds cone 19 on bearing pin 17. In this embodiment, the retaining system comprises locking balls 21.

Cone 19 and bearing pin 17 have journal bearing surfaces that slidingly engage each other as cone 19 rotates. The spaces between the bearing surfaces contain a grease or lubricant for lubricating the bearings. A seal assembly 23 inhibits leakage of lubricant to the exterior. Seal assembly 23 also inhibits encroaching drilling fluid and debris into the bearing spaces. A lubricant compensator 25 comprising an elastomeric diaphragm has one surface exposed to the drilling fluid and other surface exposed to the lubricant for reducing a pressure differential between the lubricant and the hydrostatic pressure of the drilling fluid. Seal assembly 23 is located in a seal gland 27 that is formed at the base of bearing pin 17.

Figure 2:
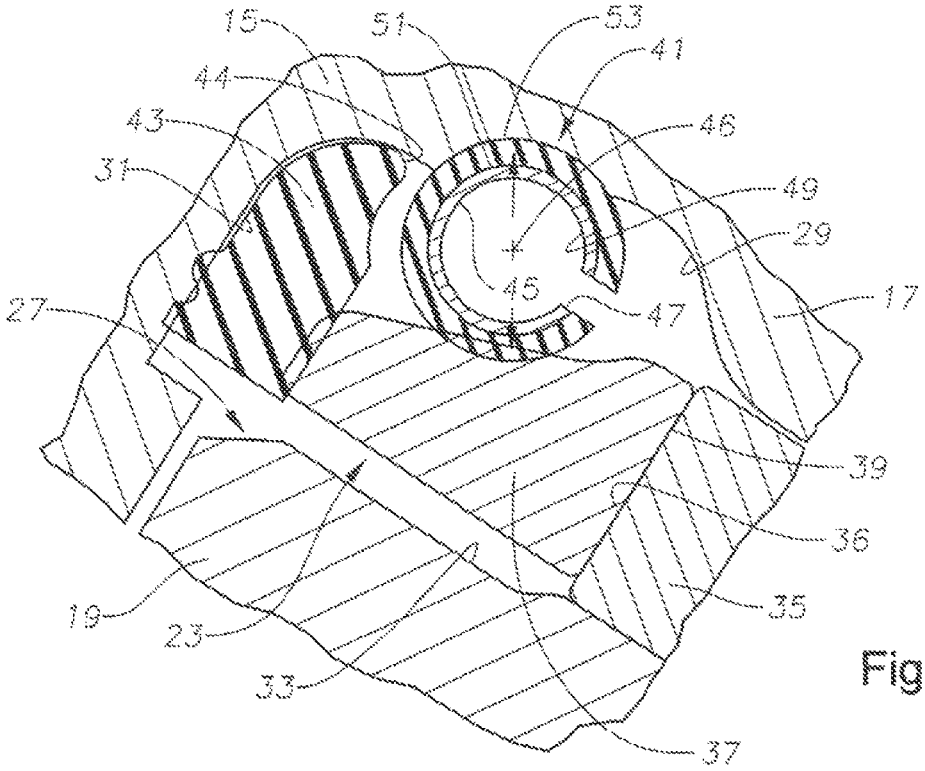
FIG. 2 is an enlarged sectional view of the seal gland and seal assembly of FIG. 1.

Seal assembly 23 and seal gland 27 may be of a variety of types. In the example of FIG. 2, seal gland 27 includes a bearing pin recess 29 that encircles bearing pin 17. Bearing pin recess 29 joins a last machined surface recess 31, which is located on bit log 15 and encircles bearing pin 17. Cone 19 has a cone cavity recess 33 spaced radially outward from bearing pin recess 29 relative to an axis of bearing pin 17. Seal gland 27 comprises the annular cavity defined by bearing pin recess 29, last machined surface recess 31 and cone cavity recess 33.

In the embodiment of FIG. 2, seal assembly 23 includes a cylindrical, rigid seal member 35 that is press fitted into the cavity of cone 19. Cone rigid seal member 35 is typically formed of steel, and it may have various wear resistant layers on its face 36, which faces last machined surface recess 31. Seal assembly 23 also includes a bearing pin rigid seal member 37. Bearing pin rigid seal member 37 is also typically an annular steel member having a seal face 39 that engages seal face 36 of cone rigid seal member 35. Seal face 39 may also have various wear resistant layers.

An annular energizing member 41 exerts a force against bearing pin rigid seal member 37, urging it against cone rigid seal member 35. In this embodiment, energizing member 41 is deformed or compressed between an inner diameter surface of bearing pin rigid seal member 37 and bearing pin recess 29. Seal assembly 23 may also have a backup seal member 43. Backup seal member 43 is an annular elastomeric ring that is deformed between last machined surface recess 31 and the outer end of bearing pin rigid seal member 37. Backup seal member 43 has a displacement portion 44 that extends radially inward from the portion that engages rigid seal member 37, relative an axis of bearing pin 17. Displacement portion 44 serves to occupy space between backup seal member 43, rigid seal member 37, and energizing member 41 that would otherwise fill with liquid.

In FIG. 2, backup seal member 43 and energizing member 41 are shown in undeformed conditions so as to illustrate the undeformed shape. When installed, they will compress or deform as indicated by the overlapping lines of the interface with the bearing pin rigid seal member 37. Part of the exterior elastomeric layer 53 will contact a mating concave recess in displacement portion 44 of backup seal member 43. The transverse cylindrical shape of energizing member 41 decreases in diameter when installed. Bearing pin recess 29 may have a rounded or contoured surface to match the contour of energizing member 41. Energizing member 41 and backup seal member 43 form static seals to inhibit the encroachment of drilling fluid into the inner diameter of bearing pin rigid seal member 37.

In FIG. 2, energizing member 41 comprises a spring 45 that is in a shape of a continuous tube extending completely around bearing pin 17. Spring 45 has a cylindrical transverse cross-section, shown in FIG. 2, with a geometric center line 46. Center line 46 is a circular line that extends around bearing pin 17 and is the geometric center of the cylindrical transverse cross-section of spring 45. Spring 45 has a circumferential gap 47 formed in it to allow it to flex in radial directions relative to center line 46. Gap 47 is a continuous circumferential slit that extends around the annular circumference of spring 45. Gap 47 results in a generally C-shaped configuration when viewed in a transverse cross-section as shown in FIG. 2. Spring 45 has a cylindrical interior surface 49 and a cylindrical exterior surface 51. Surfaces 49 and 51 are concentric with each other and with center line 46. Spring 45 is formed of a metallic resilient material.

Energizing member 41 includes elastomeric layer 53 on exterior surface 51. Elastomeric layer 53 may be a type of elastomer that is typically utilized for seal assemblies of earth-boring bits. In the embodiment of FIG. 2, elastomeric layer 53 is utilized only on the exterior surface 51 of spring 45, but it could also be utilized on the interior surface 49. Gap 47 is preferably positioned so that it will not be located in contact with any sealing surfaces, such as the inner diameter of bearing pin rigid seal member 37 or bearing pin recess 29. Preferably, gap 47 is positioned to be exposed to the lubricant within the heating spaces, thus it is on the opposite side from the side that faces backup seal member 43. In the example of FIG. 2, if energizing member 41 is removed from seal gland 23 and placed on a flat surface, gap 47 would be on the lower side and not visible from a top view. The dimensions of spring 45 and thickness of elastomeric layer 53 are selected so that when energized, gap 47 will not be completely closed. When spring 45 is squeezed, the resiliency of spring 45 is exerted in opposite outward directions along radial lines of center line 46, as indicated by the arrows in FIG. 2. Backup seal member 43 could also be constructed with a metal spring in a similar manner as energizing ring 41.

Figure 3:
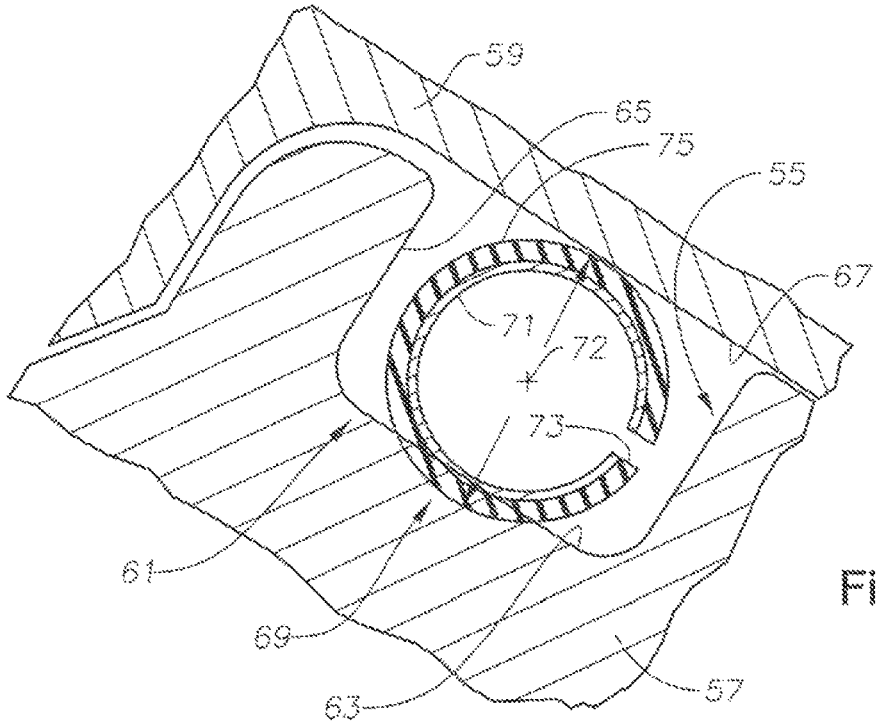
FIG. 3 is an enlarged sectional view of an alternative embodiment of a seal gland and seal assembly in accordance with this invention.

Referring to FIG. 3, in this embodiment seal gland 55 comprises a type that is typically utilized for an elastomeric ring as the primary seal. For example, seal gland 55 has a configuration for receiving an O-ring seal. Seal gland 55 is located within a second member or cone 57 that rotates on a first member or bearing pin 59. Seal gland 55 includes a cone groove 61 fanned in a cavity of cone 57. Groove 61 has a cylindrical base 63 and at least one side wall 65. In this embodiment, two parallel side walls 65 are employed. Seal gland 55 also includes a bearing pin seal surface 67 that is a cylindrical surface located on bearing pin 59.

A primary seal 69 seals between groove base 63 and bearing pin seal surface 67. Primary seal 69 may be constructed in the same manner as energizing member 41, having a tubular annular spring 71 with a circular geometric center line 72 and a circumferentially extending gap 73. Elastomeric layer 75 covers the exterior of spring 71. The portion of elastomeric layer 75 engaging bearing pin seal surface 67 slides on bearing pin seal surface 67 as cone 57 rotates. Normally, the surface of elastomeric layer 75 engaging groove base 63 rotates in unison with cone 57. The portion of elastomeric layer 75 engaging bearing pin seal surface 67 may contain friction reducing additives to enhance the dynamic sealing engagement with beating pin seal surface 67. The portion of elastomeric layer 75 engaging groove base 63 may contain other additives to enhance frictional contact. Gap 73 does not contact either groove base 63 or bearing pin seal surface 67. Preferably gap 73 is exposed to lubricant contained within the bearing spaces. Spring 71 is shown in its undeformed position. When squeezed between groove base 63 and bearing pin seal surface 67, gap 73 will decrease in width and the cylindrical transverse cross section of primary seal 69 decreases. The resiliency of spring 71 causes radial outward and oppositely directed forces relative to center line 72, as indicated by the arrows in FIG. 3.

Figure 4:
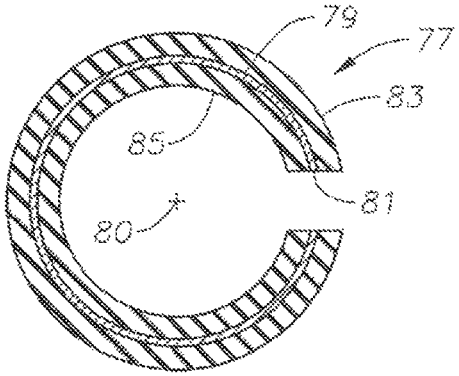
FIG. 4 is a transverse sectional view of another alternative embodiment of a seal component in accordance with this invention.

Referring to FIG. 4, seal component 77 may be utilized in lieu of energizing ring 41 in FIG. 2 or primary seal 69 in FIG. 3. Seal component 77 has a tubular spring 79 that is annular in configuration as in the other two embodiments. Spring 79 has a geometric center line 80 that is a circle. A gap 81 extends circumferentially around spring 79. An exterior elastomeric layer 83 is located on the exterior of spring 79. In this embodiment, an interior elastomeric layer 85 is located in the interior. Layers 83 and 85 may be the same, or they may be different from each other. Layer 85 serves to prevent corrosion to spring 79.

Figure 5:
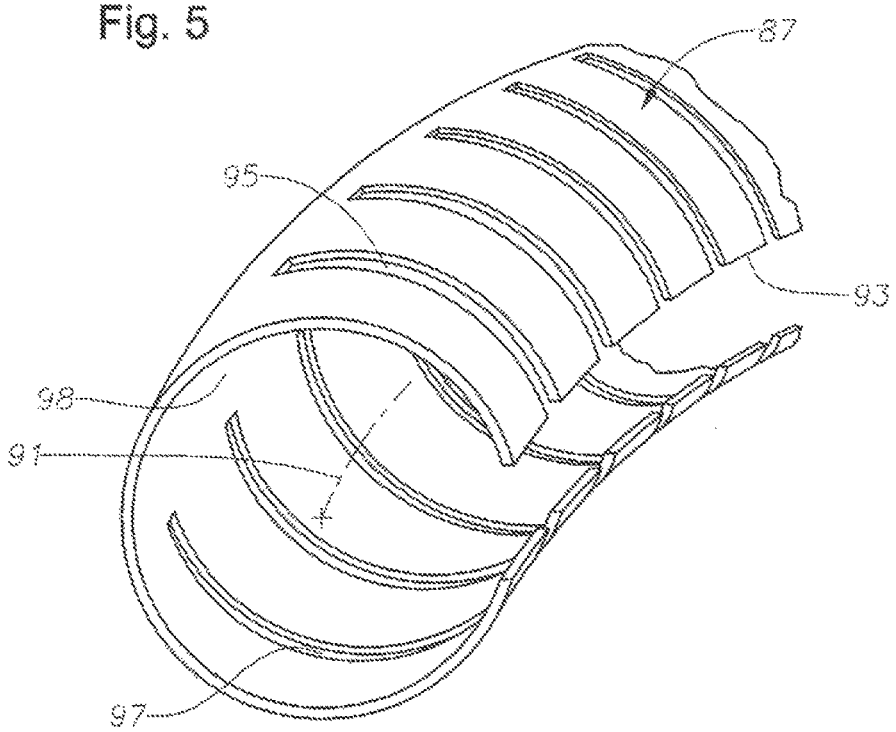
FIG. 5 is a perspective view of a portion of another alternative embodiment of a spring for a seal component in accordance with this invention.

FIG. 5 illustrates a spring 87 that may be employed in lieu of springs 45, 71 and 79 of the embodiments in FIGS. 2, 3 and 4. Spring 87 is also a metallic tubular annular element extending continuously around the seal gland. Spring 87 is generally cylindrical in transverse cross section as in the other embodiments and has a circular geometric center line 91. Spring 87 has a gap 93 extending circumferentially around it in the same manner as gaps 47, 73 and 81 in FIGS. 2, 3 and 4. A plurality of transverse slits 95 extend from gap 93 partially around the cylindrical wall of spring 87. Each slit 95 may be located in a plane that is normal to center line 91. Slits 95 are parallel, spaced apart from, each other and extend in a row completely around the annular circumference of spring 87. A second set of slits 97 is located on an opposite side of spring 87 from slits 95. Slits 97 extend from the opposite edge of gap 93 in the opposite direction. The closed ends of gap 93 and slit 95 are spaced apart from each other, defining a continuous solid metal band 98 extending around the annular circumference of spring 87. Slits 97 may be identical to slits 95 in width and length. If spring 87 is placed on a flat surface and viewed from above, gap 93 would be on the lower side, band 98 on an upper side, and slits 95, 97 on opposite sides.

Slits 97 isolate or decouple portions of spring 87 from other portions. For example, the squeeze on spring 87 could be momentarily greater on one part of spring 87 than another part. This might occur due to rocking of cone 57 relative to bearing pin 59 (FIG. 3). The rocking might cause the squeeze on spring 87 to be greater on a lower side of bearing pin 59 than an upper side. The additional squeeze on the lower side will cause the lower side of spring 87 to shrink in cross-sectional diameter. However, it will not cause the upper side of annular spring 87 to shrink in cross-sectional diameter because transverse slits 97 decouple the portions of spring 87 that are spaced circumferentially apart from each other.

Figure 6:
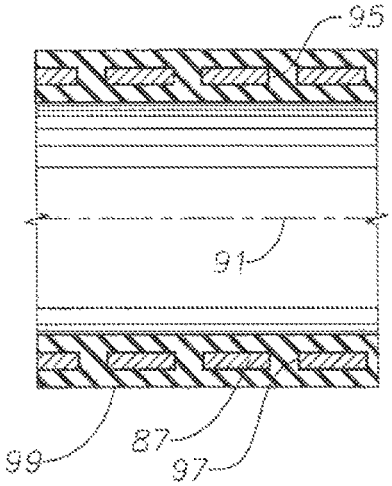
FIG. 6 is a sectional view of the spring of FIG. 5 taken along the line 6-6 and showing an elastomeric layer added to the spring.

FIG. 6 illustrates a sectional view of a portion of spring 87, but also containing an elastomeric layer 99. The width of each slit 95 or 97 is fairly small. The maximum width will be selected to avoid an unacceptable loss of sealing force between the metal portions bounding each slit 95 or 97. For example, the slit width may be a fraction, such as one-fourth to one-half, of the thickness of elastomeric layer 99. Layer 99 is located within slits 95 and 97 as well as on the exterior side of spring 87. Further, in this example, elastomeric layer 99 is also located on the interior surfaces of spring 87.

Figure 7:
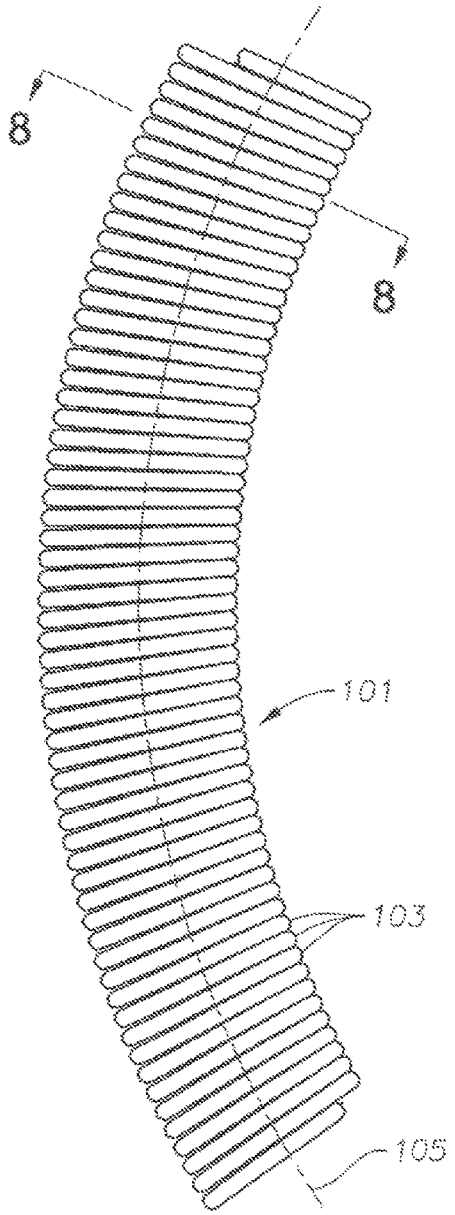
FIG. 7 is top view of a portion of another embodiment of a spring for a seal component in accordance with this invention.
Figure 8:
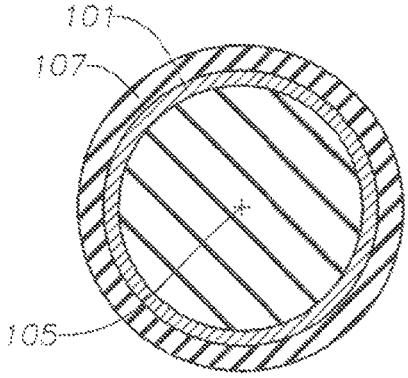
FIG. 8 is a transverse sectional view of the spring of FIG. 7 taken along the line 8-8 and also showing an elastomeric layer on the spring.

Referring to FIG. 7, in this embodiment, spring 101 may be substituted for any of the springs 45, 71, 79 or 87. Spring 101 comprises a wire that is helically wound to form helical turns 103 around a circular geometric center line 105 (FIG. 8). Helical turns 103 are preferably continuous and extend completely around the seal glands in which spring 101 is installed. The transverse cross-sectional view, shown in FIG. 8, is cylindrical. Elastomeric layer 107 covers the exterior and is located between the helical turns 103 (FIG. 7). Also, in this example, an elastomeric material may completely fill the interior of spring 101. The elastomer within the interior of the helically wound spring 101 retards a loss of sealing force with increasing hydrostatic pressure. Spring 101 achieves its resiliency from the helical turns of wire, thus does not have a gap extending around it as depicted in other embodiments. The helical turns 103 provide a toroidal configuration for spring 101.

Figure 9:
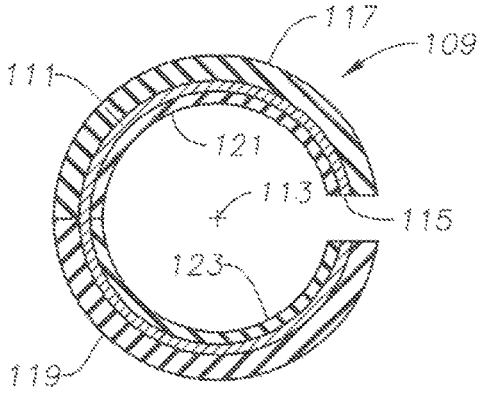
FIG. 9 is a transverse sectional view of another embodiment of a seal component in accordance with this invention.

Referring to FIG. 9, seal component 109 has a spring 111 that may be identical to springs 45 and 71. Spring 111 could also be configured as springs 79, 87 or 101. Spring 111 has a cylindrical configuration, when viewed in transverse cross-section. Spring 111 has a circular center line 113 and a gap 115 extends around its annular circumference. In this embodiment, spring 111 has a dynamic exterior layer 117 with properties for improved dynamic or sliding engagement. Dynamic exterior layer 117 may thus have components that reduce its friction and enhance wear resistance. Dynamic exterior layer 117 extends completely around the annular circumference of spring 111, but covers only half or the cylindrical exterior of spring 111. A static exterior layer 119 covers the other cylindrical half of spring 111 and extends completely around the annular circumference of spring 111. Static exterior layer 119 is different in composition from exterior layer 117 as it may contain additives for improving a static sealing engagement, such as additives to provide a higher surface friction. In this embodiment, static exterior layer 119 is opposite from dynamic exterior layer 117 when viewed in transverse cross-section, as shown in FIG. 9. Layers 117 and 119 begin at gap 115 and join each other approximately 180° from gap 115.

In the example of FIG. 9, two separate interior layers 121 and 123 are shown. Interior layers 121 and 123 are located on the interior of spring 111 and may differ from each other and differ from exterior layers 117 and 119. Interior layers 121 and 123 extend around the annular circumference of spring 111, and each covers approximately one-half of the cylindrical interior of spring 111 in this embodiment. Interior layers 121 and 123 serve to resist corrosion of spring 111. The two separate and different exterior layers 117 and 119 could be employed with two interior layers 121, 123, as shown, or with a single interior layer or with no interior elastomeric layer.

Figure 10:
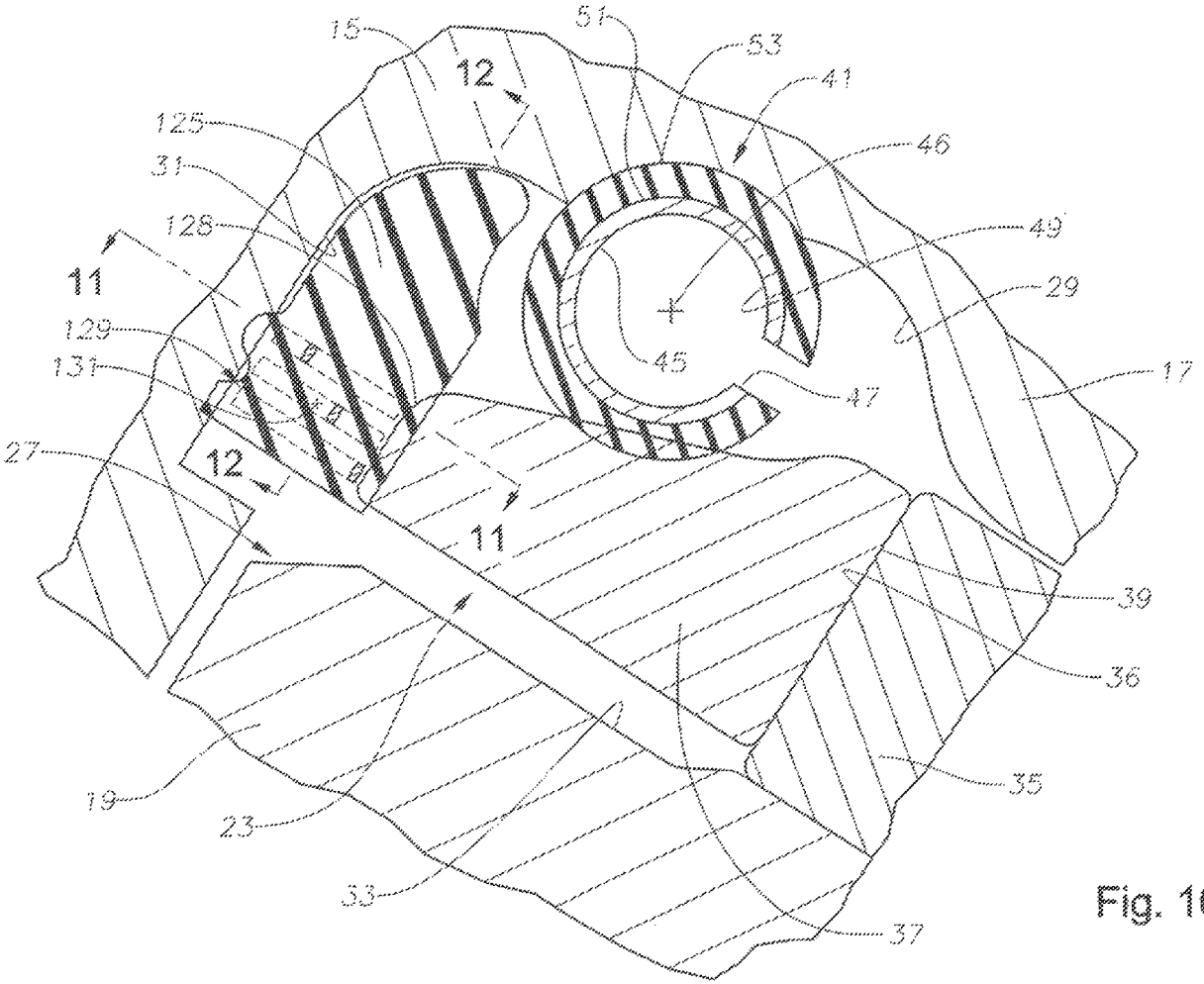
FIG. 10 is a transverse sectional view of the seal gland of FIG. 2, but with another embodiment of an energizing ring.

FIG. 10 shows many of the same components as FIG. 2, thus they will be labeled with the same numerals. A difference between FIG. 10 and FIG. 2 is in the backup seal member 125. Backup seal member 125 has a displacement portion extending inward from the sealing portion relative to an axis of bearing pin 17. The sealing portion, which is squeezed between bit leg 15 and rearward end 128 of rigid seal member 37, contains a spring assembly 129, which is shown by dotted lines. Spring assembly 129 has a geometric center line 131 that is located equidistant between bit leg 15 and rigid seal member 37. Geometric center line 131 is also centered between the outer and inner diameters of rearward end 128 of the rigid seal member 37.

Figure 11:
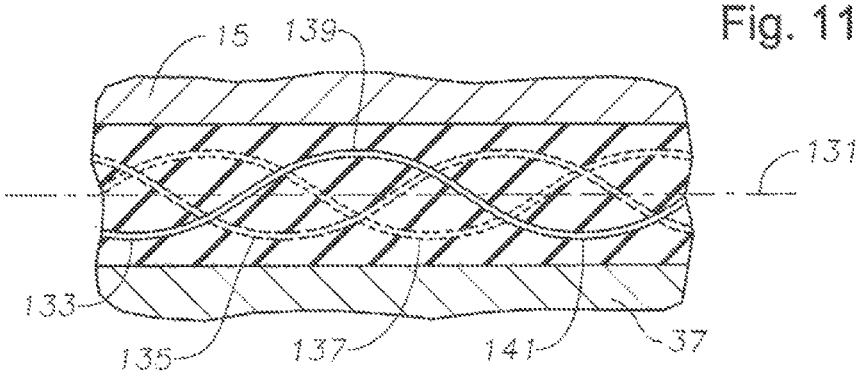
FIG. 11 is a simplified sectional view of the energizing ring of FIG. 10, taken along the line 11-11 of FIG. 10.

Referring to FIG. 11, spring assembly 129 includes at least one wavy member or spring 133, and preferably more than one. In this example, three wavy members 133, 135 and 137 are illustrated. For clarification, wavy member 133 is shown by solid lines, wavy member 135 by dotted lines, and wavy member 137 by dashed lines, but in actuality, each comprises a wire or a strip of metal. Each wavy member 133, 135, 137 undulates, such as in a sinusoidal pattern as illustrated. The undulation is in a rearward and foreword direction, with rearward considered to be to the left, or toward bit leg 15, and forward in the opposite direction. Each wavy member 133, 135, 137 has peaks 139 and valleys 141, with peaks 139 being closer to bit leg 15 than valleys 141. Valleys 141 are closer to rigid seal 37 than peaks 139. The terms "peak" and "valleys" are arbitrarily chosen and could be reversed. In this example, the sinusoidal pattern of each wavy member of spring assembly 129 has the same pitch of undulations, but that is not essential. Also, preferably, the wavy members 133, 135, 137 of spring assembly 129 are out of phase. The peak 139 of first wavy member 133 is 60 degrees out of phase with second wavy member 135 and 120 degrees out of phase with third wavy member 137. The pattern is similar to the wave form of three-phase alternating-current electrical power.

Figure 12:
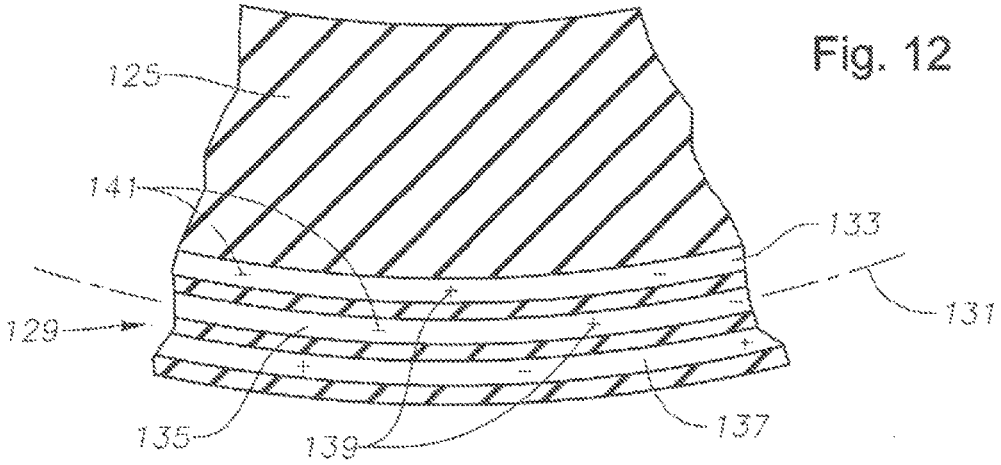
FIG. 12 is a schematic sectional view of the energizing ring of FIG. 10, taken along the line 12-12 of FIG. 11.

The three wavy members of spring assembly 129 may be side-by-side, as schematically illustrated in FIG. 12, and they may be touching each other. Spring assembly 129 is embedded in the sealing portion of backup seal member 125. When squeezed between bit leg 15 and end 128 of rigid seal 37, the undulations of spring assembly 129 compress and exert forces radially in forward and rearward directions relative to center line 131.

Figure 13:
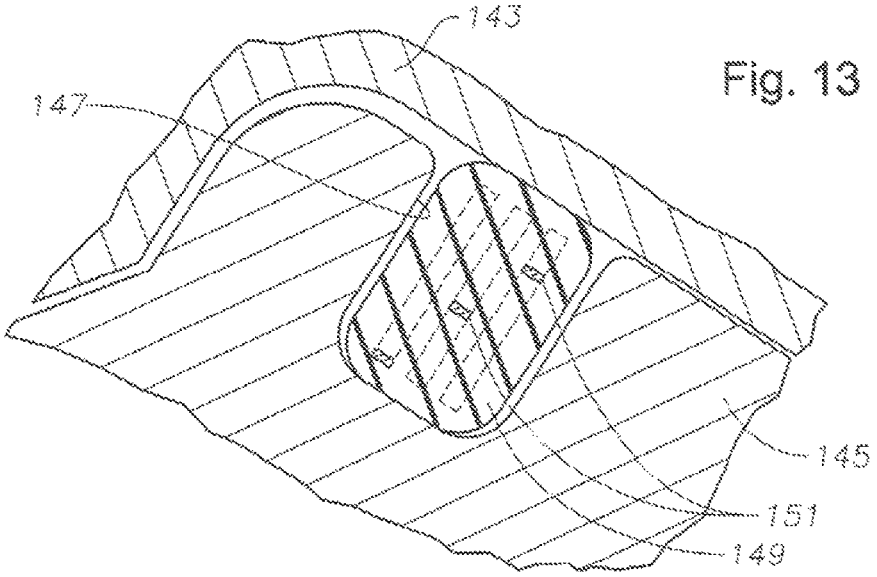
FIG. 13 is a schematic sectional view of another seal gland and embodiment of a primary seal in accordance with this invention.

FIG. 13 shows a portion of bearing pin 143 located within a rotatable cone 145. A seal gland is provided by an annular groove 147. Groove 147 is considered to be a high aspect ratio type, having a radial dimension from its inner diameter to its outer diameter that is considerably greater than its width between side walls. A seal 149 is deformed in groove 147, with, its inner diameter in sliding and sealing engagement with bearing pin 143. Seal 149 is an elastomer having an embedded metal spring assembly 151. Spring assembly 151 has at least one, and preferably a plurality of wavy members as described in connection with FIGS. 10-12. The undulations result in peaks closer to bearing pin 143 than valleys. The valleys are closer to the base of groove 147 than the peaks. When squeezed, spring 151 exerts a radial inward force and a radial outward force between the base of groove 147 and bearing pin 143.

The metallic spring of each embodiment should have a high yield strain; in other words, a high yield stress over Young's Modulus ratio, and no detectable creep deformation or loss of strength at the maximum point of the operating temperature. This requirement may restrict the use of low melting point metal such as aluminum and its alloys and may restrict the use of austenitic stainless steels. The metal of spring should not corrode in service if exposed to drilling fluid or the bearing lubricant. Materials for the spring may include beryllium copper alloys and ferritic spring steels.

In some applications, such as in FIG. 3, part of the elastomeric layer will be in sliding and scaling engagement with a surface of the seal gland. In other embodiments, such as in FIGS. 2 and 10, the exterior elastomeric layer will not have any dynamic engagement, rather it will be in static engagement with surfaces of the seal gland and seal assembly. Consequently, it may be desirable to have higher friction characteristics than if utilized in a dynamic engagement. The higher frictional characteristics will restrict an undesired and potentially detrimental rotation of another sealing element when utilized as energizing member for a metal face seal member. A typical material for the various elastomeric layers is hydrogenated nitrite butadiene rubber (HNBR). If in dynamic engagement on one of its surfaces, the rubber properties may be optimized for low friction and wear resistance by impregnating the HNBR with other materials. In applications that demand very high temperature elements, perfluoroelastomers (FFKM) may be appropriate rather than HNBR.

In each of the embodiments, the springs are designed to achieve a desired sealing force and have characteristics appropriate for the application in question. The metal springs provide the sealing force and the elastomeric components provide the conformable sealing surfaces. As disclosed, the composite sealing elements may be used as primary seals in some applications or as energizing members in other applications, such as in mechanical face seals. Several embodiments show springs of "C" shaped configuration. The annular gap in the springs of the various embodiments could remain open to allow emission of fluid into the interior. Alternatively, the interiors of the springs and the gaps could be filled with an elastomer or other low modulus material. The filling material within the interior could be a foam, with open or closed cells. The selection of the open or closed cell foam would influence the impact of a change in seal fluid pressure on the sealing force.

The various embodiments provide sealing force characteristics that do not significantly change during service even in an elevated temperature. The sealing surface characteristics show improved wear resistance during service. The metallic material of each seal component would be chosen so that it does not change strength or shape during service. The use of low friction additives improves wear resistance of the elastomeric for the dynamic outer surfaces, thus reducing loss of cross-sectional area due to wear. The reduction in wear resistance of the elastomer and the constant sealing force provided by the metallic spring should minimize changes in sealing force characteristics during extending service life. An additional benefit from the use of a metallic spring component arises because metals have a much lower internal damping than elastomers. Consequently, the sealing elements should be able to respond much more rapidly to relative displacements of the surfaces being sealed, reducing the potential for drilling fluid ingress due to transit cone rocking or inward loads.

While the invention has been shown in only a few of its forms, it should be apparent to those skilled in the art that is not so limited but is susceptible to various changes without departing from the scope of the invention. For example, although all the embodiments show a spring having a transverse circular or cylindrical configuration, other transverse configurations are feasible.

The invention claimed is:

1. A downhole well tool having an inner member located within an outer member, one of the members being rotatable relative to the other of the members, an annular seal gland located between the members, and a seal assembly located in the seal gland, comprising:

a seal ring comprising an elastomeric material, the elastomeric material having a substantially uniform thickness in a transverse cross-section; and an annular metallic spring having an exterior surface fully covered by the elastomeric material of the seal ring, the spring having a geometric center line that extends in a circle around the inner member, the spring being elastically deformable such that when the seal ring is installed in the seal gland, the spring will exert oppositely directed forces along radial lines from the center line, wherein the spring has a shape of a tube with a continuous circumferential slit.

2. The downhole well tool according to claim 1, wherein the seal ring comprises a primary seal having a first elastomeric part in sliding and sealing contact with the inner member and another elastomeric part in stationary sealing contact with the outer member.

3. The downhole well tool according to claim 1, wherein the seal assembly further comprises:

a non-rotating rigid face seal and a rotating rigid face seal, one of the rigid face seals being mounted to one of the members for rotation therewith and the other to the other of the members;

wherein the seal ring comprises an energizing member biased against one of the rigid face seals and urging the one of the rigid face seals into sealing and sliding engagement with the other of the rigid face seals.

4. The downhole well tool according to claim 1, wherein the seal assembly further comprises:

a non-rotating rigid face seal and a rotating rigid face seal, one of the rigid face seals being mounted to one of the members for rotation therewith and the other face seal mounted to the other member; and an energizing ring biased between the inner member and the non-rotating rigid face seal;

wherein the seal ring comprises a backup seal member sealing between the inner member and the non-rotating rigid face seal and spaced from the energizing ring.

5. The downhole well tool according to claim 1, wherein the seal ring further comprises:

a backup seal formed of an elastomeric material; and an annular metallic spring fully embedded within the elastomeric material of the backup seal, wherein the annular metallic spring comprises at least one wavy member having undulations.

6. The downhole well tool according to claim 5, wherein the spring comprises a plurality of wavy members, each having undulations and being positioned side-by-side.

7. The downhole well tool according to claim 1, wherein the spring has a cylindrical configuration in a transverse cross-section.

8. A downhole well tool having an inner member located within an outer member, one of the members being rotatable relative to the other of the members, an annular seal gland located between the members, and a seal assembly located in the seal gland, the seal assembly comprising:

a first annular metallic spring fully embedded within a first elastomeric material of the seal ring, the first annular metallic spring having a geometric center line that extends in a circle around the inner member, the first annular metallic spring being elastically deformable such that when the seal ring is installed in the seal gland, the first annular metallic spring will exert oppositely directed forces along radial lines from the center line;

a backup seal comprising a second elastomeric material; and a second annular metallic spring fully embedded within the second elastomeric material of the backup seal, wherein the second annular metallic spring comprises a plurality of wavy members, each having undulations and being positioned side-by-side, wherein the undulations of each of the wavy members are at the same frequency as the other wavy members but out of phase.

9. The downhole well tool according to claim 8, wherein the seal ring comprises a primary seal having a first elastomeric portion in sliding and sealing contact with the inner member and another elastomeric portion in stationary sealing contact with the outer member.

10. The downhole well tool according to claim 8, wherein the seal assembly further comprises:

a non-rotating rigid face seal and a rotating rigid face seal, one of the rigid face seals being mounted to one of the members for rotation therewith and the other to the other of the members;

wherein the seal ring comprises an energizing member biased against one of the rigid face seals and urging the one of the rigid face seals into sealing and sliding engagement with the other of the rigid face seals.

11. The downhole well tool according to claim 8, wherein the seal assembly further comprises:

a non-rotating rigid face seal and a rotating rigid face seal, one of the rigid face seals being mounted to one of the members for rotation therewith and the other face seal mounted to the other member; and an energizing ring biased between the inner member and the stationary rigid face seal;

wherein the seal ring comprises a backup seal member sealing between the inner member and the non-rotating rigid face seal and spaced from the energizing ring.

12. The downhole well tool according to claim 8, wherein the spring has a shape of a tube with a continuous circumferential slit.

13. The downhole well tool according to claim 12, wherein the spring has a cylindrical configuration in a transverse cross-section.

* * * * *